US007743823B2

(12) United States Patent
Hughes et al.

(10) Patent No.: US 7,743,823 B2
(45) Date of Patent: Jun. 29, 2010

(54) FORCE BALANCED ROTATING PRESSURE CONTROL DEVICE

(75) Inventors: William James Hughes, Bixby, OK (US); Murl Ray Richardson, Ft. Worth, TX (US); Thomas L. Pettigrew, College Station, TX (US); Kurt D. Vandervort, Cypress, TX (US); Kenneth D. Young, Kingwood, TX (US)

(73) Assignee: Sunstone Technologies, LLC, Oklahoma City, OK (US)

( * ) Notice: Subject to any disclaimer, the term of this patent is extended or adjusted under 35 U.S.C. 154(b) by 334 days.

(21) Appl. No.: 11/757,892

(22) Filed: Jun. 4, 2007

(65) Prior Publication Data

US 2008/0296016 A1 Dec. 4, 2008

(51) Int. Cl.
*E21B 33/06* (2006.01)

(52) U.S. Cl. ..... 166/84.3; 277/926

(58) Field of Classification Search ..... 166/84.1, 166/84.3, 84.4; 277/605, 646, 926
See application file for complete search history.

(56) References Cited

U.S. PATENT DOCUMENTS

| | | | | |
|---|---|---|---|---|
| 2,945,665 | A * | 7/1960 | Regan et al. | 277/332 |
| 4,073,352 | A | 2/1978 | Underwood | 175/53 |
| 4,095,656 | A | 6/1978 | French | 175/53 |
| 4,448,255 | A | 5/1984 | Shaffer et al. | 166/387 |
| 4,949,785 | A | 8/1990 | Beard et al. | 166/84 |
| 5,062,479 | A | 11/1991 | Bailey et al. | 166/84 |
| 5,178,215 | A | 1/1993 | Yenulis et al. | 166/80 |
| 5,273,108 | A | 12/1993 | Piper | 166/90 |
| 5,279,365 | A | 1/1994 | Yenulis et al. | 166/84 |
| 5,507,465 | A | 4/1996 | Borle | 251/1.2 |
| 5,848,643 | A | 12/1998 | Carbaugh et al. | 166/85.4 |
| 6,016,880 | A | 1/2000 | Hall et al. | 175/195 |
| 6,024,172 | A | 2/2000 | Lee | 166/363 |
| 6,109,348 | A | 8/2000 | Caraway | 166/84.3 |
| 6,129,152 | A | 10/2000 | Hosie et al. | 166/384 |
| 6,227,547 | B1 | 5/2001 | Dietle et al. | 277/336 |
| 6,244,336 | B1 | 6/2001 | Kachich | 166/55 |
| 6,470,975 | B1 | 10/2002 | Bourgoyne et al. | 175/57 |
| 6,520,253 | B2 | 2/2003 | Calder | 166/84.4 |
| 6,554,016 | B2 | 4/2003 | Kinder | 137/12 |
| 6,626,245 | B1 | 9/2003 | Dallas | 166/379 |
| 7,004,444 | B2 * | 2/2006 | Kinder | 251/1.2 |
| 7,040,394 | B2 * | 5/2006 | Bailey et al. | 166/84.4 |
| 7,080,685 | B2 * | 7/2006 | Bailey et al. | 166/84.4 |
| 2002/0104660 | A1 | 8/2002 | Nice et al. | 166/368 |
| 2005/0241833 | A1 * | 11/2005 | Bailey et al. | 166/379 |
| 2006/0037744 | A1 * | 2/2006 | Hughes et al. | 166/85.4 |

* cited by examiner

*Primary Examiner*—William P Neuder
(74) *Attorney, Agent, or Firm*—Yee & Associates, P.C.; Rudolf O. Siegesmund

(57) ABSTRACT

Force balancing adjusts hydraulic fluid pressure in an upper piston area of a Rotating Pressure Control Device (RPCD) that has an inner housing rotatably engaged within an outer housing by an upper bearing and a lower bearing. The hydraulic fluid pressure is adjusted to balance net force in a upper piston area and a lower piston area. The fluid pressure adjustment creates a force differential that balances the total load transmitted through the upper bearing and the lower bearing and thereby extends the life of the sealing element and bearings. Additionally, a wear indicator signals the end of the useful life of the drill pipe sealing element.

9 Claims, 6 Drawing Sheets

FORCE BALANCED ROTATING PRESSURE CONTROL DEVICE

CROSS-REFERENCE TO RELATED APPLICATION

The present invention is related to the subject matter of U.S. patent application Ser. No. 10/922,029.

FIELD OF THE INVENTION

The present invention is directed generally at drilling blowout preventers used in drilling oil and gas wells, and specifically to a rotating pressure control device for use in both under-balanced drilling applications and managed pressure drilling applications.

BACKGROUND OF THE INVENTION

When the hydrostatic weight of the column of mud in a well bore is less than the formation pressure, the potential for a blowout exists. A blowout occurs when the formation expels hydrocarbons into the well bore. The expulsion of hydrocarbons into the well bore dramatically increases the pressure within a section of the well bore. The increase in pressure sends a pressure wave up the well bore to the surface. The pressure wave can damage the equipment that maintains the pressure within the well bore. In addition to the pressure wave, the hydrocarbons travel up the well bore because the hydrocarbons are less dense than the mud. If the hydrocarbons reach the surface and exit the well bore through the damaged surface equipment, there is a high probability that the hydrocarbons will be ignited by the drilling or production equipment operating at the surface. The ignition of the hydrocarbons produces an explosion and/or fire that is dangerous for the drilling operators. In order to minimize the risk of blowouts, drilling rigs are required to employ a plurality of different pressure control devices, such as an annular pressure control device, a pipe ram pressure control device, and a blind ram pressure control device. If a "closed loop drilling" method is used, then a rotating pressure control device will be added on top of the conventional pressure control stack. Persons of ordinary skill in the art are aware of other types of pressure control devices. The various pressure control devices are positioned on top of one another, along with any other necessary surface connections, such as the choke and kill lines for managed pressure drilling applications and nitrogen injection lines for under balanced drilling applications. The stack of pressure control devices and surface connections is called the pressure control stack.

One of the devices in the pressure control stack can be a rotating pressure control device also referred to as a rotating pressure control head. The rotating pressure control head is located at the top of the pressure control stack and is part of the pressure boundary between the well bore pressure and atmospheric pressure. The rotating pressure control head creates the pressure boundary by employing a ring-shaped rubber or urethane sealing element that squeezes against the drill pipe, tubing, casing, or other cylindrical members (hereinafter, drill pipe). The sealing element allows the drill pipe to be inserted into and removed from the well bore while maintaining the pressure differential between the well bore pressure and atmospheric pressure. The sealing element may be shaped such that the sealing element uses the well bore pressure to squeeze the drill pipe or other cylindrical member. However, some rotating pressure control heads utilize some type of mechanism, typically hydraulic fluid, to apply additional pressure to the outside of the sealing element. The additional pressure on the sealing element allows the rotating pressure control head to be used for higher well bore pressures.

The sealing element on all rotating pressure control heads eventually wear out because of friction caused by the rotation and/or reciprocation of the drill pipe. Additionally, the passage of pipe joints, down hole tools, and drill bits through the rotating pressure control head causes the sealing element to expand and contract repeatedly, which also causes the sealing element to become worn. Other factors may also cause wear of the sealing element, such as extreme temperatures, dirt and debris, and rough handling. When the sealing element becomes sufficiently worn, it must be replaced. If a worn sealing element is not replaced, it may rupture, causing a loss of hydraulic fluids and control over the well head pressure.

Currently, visual inspections or time based life span estimates are used to determine when to replace a worn sealing element. Visual inspections are subjective, and may be unreliable. Time based estimates may not take into account actual operating conditions, and be either too short or too long for a particular situation. If the time based estimate is too conservative, then sealing elements are replaced too frequently, causing unnecessary expense and delay. If the time based estimate is too aggressive, then the risk for rupture may be unacceptable.

U.S. patent application Ser. No. 10/922,029 (the '029 application) discloses a Rotating Pressure Control Head (RPCH) having a sealing element in an inner housing where the inner housing is rotatably engaged to an outer housing by an upper bearing and a lower bearing. The RPCH of the '029 application offers many improvements over the prior art including a shorter stack size, a quick release mechanism for inner unit change out, and a reduction in harmonic vibrations. Further improvements can be sought in ways to extend the life of the components. Wellbore fluid pressure, pressurized hydraulic fluid, and pipe friction against the sealing element exert a net upward or downward force on the inner housing that translates into a load on the upper and lower bearings. The load on the upper and lower bearings generates heat which is the most significant factor in bearing wear and life expectancy. A need exists for a way to balance the net force on the inner housing in order to reduce heat and wear on the bearings. Additionally, a need exists for an objective way to determine when a sealing element is sufficiently worn and needs to be replaced, without causing waste from early replacement, and without increasing the risk of rupture.

SUMMARY OF THE INVENTION

A Rotating Pressure Control Device (RPCD) uses pressure balancing so that a force transmitted through the bearings from an inner housing to an outer housing is balanced, thereby increasing the service life of the bearings.

The RPCD comprises an upper body and a lower body that form an outer housing. An inner housing rotates with respect to the outer housing. The inner housing has a sealing element that constricts around the drill pipe, and bearings are placed between the inner housing and outer housing to allow rotation of the inner housing within the outer housing.

An upper dynamic rotary seat is located between the inner housing and the outer housing and above the sealing element. A middle dynamic rotary seal is located between the inner housing and the outer housing and below the sealing element. A lower dynamic rotary seal is located between the inner housing and the outer housing below the middle dynamic rotary seal.

An upper piston area is created between the inner housing and the outer housing by the upper dynamic rotary seal and the middle dynamic rotary seal. A lower piston area is created below the expanded sealing element between the outside of the drill pipe and the lower dynamic rotary seal.

Wellbore fluid pressure, pressurized hydraulic fluid, and pipe friction against the sealing element cause a net upward or downward force on the inner housing with respect to the outer housing. These net upward or downward forces cause wear to the bearings. By adjusting hydraulic fluid pressure in the upper piston area, users can adjust the amount of downward force exerted by the upper piston area to compensate for the upward force exerted by the lower piston area. In addition, such adjustments also compensate for forces caused by friction between the drill pipe and sealing element. The reduction in force on the inner housing achieved by pressure balancing results in reduced bearing heat and wear.

Additionally, the RPCD has an electrically conductive wear indicator integrated with the drill pipe sealing element. A conductive strip is embedded inside the sealing element. The conductive strip makes electrical contact with a first electrode of an electrical indicator. A second electrode of the electrical indicator is in electrical contact with the drill pipe. When the sealing element is worn down to a pre-determined depth, exposing the embedded conductive strip, a closed circuit is formed from the electrical indicator through the first electrode, the embedded conductive strip, the drill pipe, and the second electrode, causing a signal on an electrical indicator, alerting users of the RPCD that it is time to replace the sealing element.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
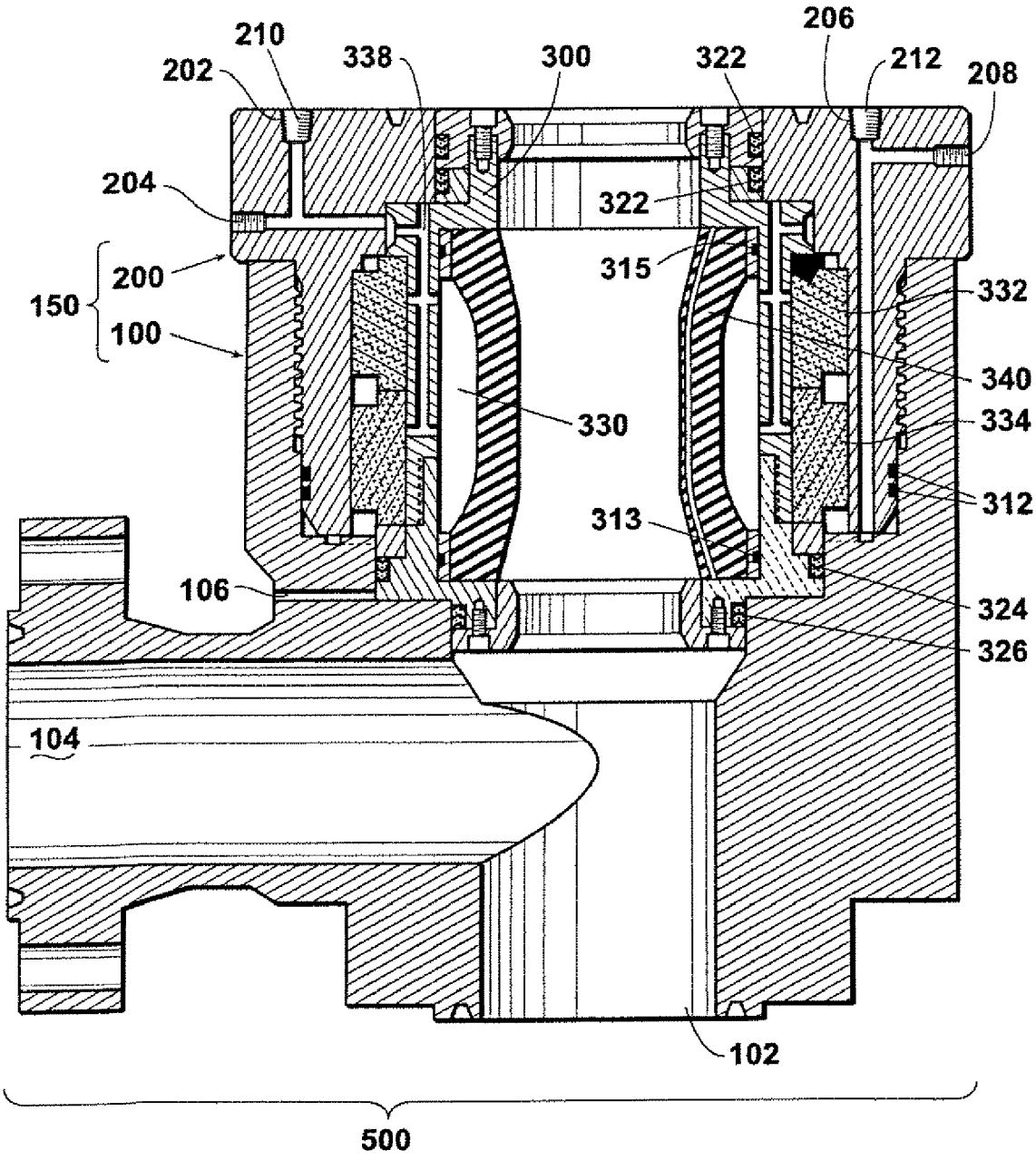
FIG. 1 is a cross sectional view of the RPCD.

FIG. 1 is a cross sectional view of pressure balanced rotating pressure control device 500. Upper body 200 and lower body 100 form outer housing 150. Inner housing 300 rotates inside outer housing 150. Inner housing 300 contains sealing element 340 adapted to constrict around a drill pipe. Upper bearing 332 and lower bearing 334 affixed to inner housing 300 provide vertical and lateral support between inner housing 300 and outer housing 150.

Input port 204 allows hydraulic fluid to enter outer housing 150 to reach channel 338, cavity 330, and spaces between inner housing 300 and outer housing 150. Alternate input port 202 is capped with input plug 210. Output port 208 allows hydraulic fluid to exit outer housing 150. Alternate output port 206 is capped with output plug 212. Wellbore fluid enters RPCD at input 102 and exits through output 104.

Upper dynamic rotary seal 322 is located between inner housing 300 and outer housing 150 and above sealing element 340 and upper bearing 332. Upper dynamic rotary seal 322 is shown here as two separate dynamic rotary seals.

Middle dynamic rotary seal 324 is located between the inner housing 300 and outer housing 150, below sealing element 340, and below lower bearing 334. Middle dynamic rotary seal 324 has a wider diameter than upper dynamic rotary seal 322.

Lower dynamic rotary seal 326 is located between the inner housing 300 and outer housing 150 below middle dynamic rotary seal 324.

Vent port 106 allows open space between middle dynamic rotary seal 324 and lower dynamic rotary seal 326 to remain at atmospheric pressure. In addition, vent port 106 serves as a leak detection system because in the event that middle dynamic rotary seal 324 or lower dynamic rotary seal 326 begin to leak, fluid will drain from vent port 106 revealing the leak.

Pair of o-rings 312 sit between upper body 200 and lower body 100. Upper sealing element o-ring (or upper alternate sealing element) 315 and lower sealing element o-ring (or lower alternate sealing element) 313 sit between sealing element 340 and inner body 300.

Figure 2:
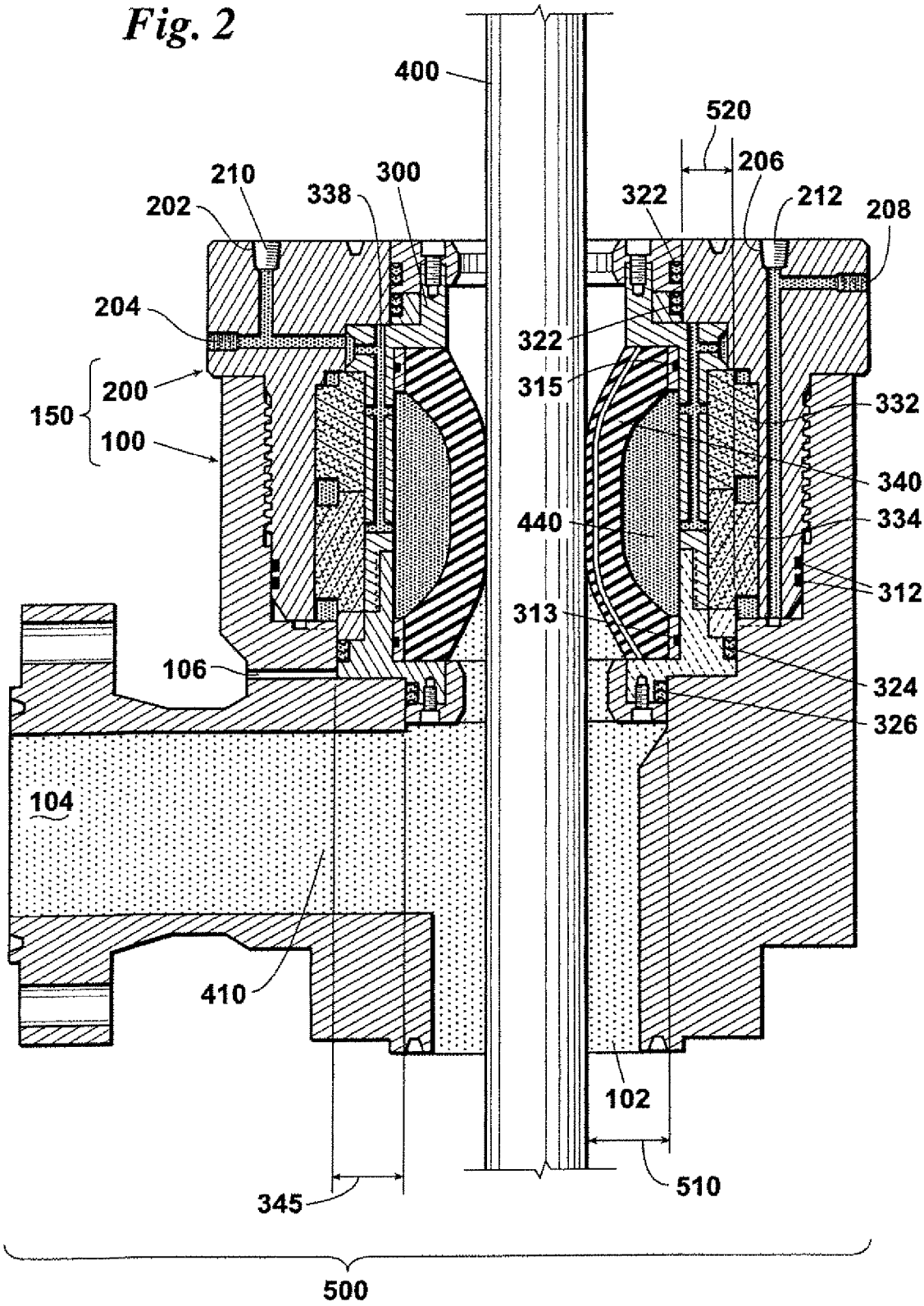
FIG. 2 is a cross sectional view of the RPCD with the sealing element in an expanded position.

FIG. 2 is a cross sectional view of pressure balanced rotating pressure control device 500 with sealing element 340 in an expanded position around drill pipe 400.

Pressurized hydraulic fluid 440 enters outer housing 300 through input port 204. Alternate input port 202 is capped with input plug 210. Pressurized hydraulic fluid 440 expands sealing element 340 around drill pipe 400. Hydraulic fluid 440 permeates the area between inner housing 300 and outer housing 150 between upper dynamic rotary seal 322 and middle dynamic rotary seal 324. Hydraulic fluid 440 lubricates upper bearing 332 and lower bearing 334. Pressurized hydraulic fluid 440 exits outer housing through output port 208 for recirculation. Alternate output port 206 is capped by output plug 212.

Upper piston area 520 is defined by the equation $A(up)=(\pi\times(D)(Ms)^2-D(us)^2)/4$ where D(ms)=middle dynamic seal ring 324 outer diameter, and where D(us)=upper dynamic rotary seal 322 outer diameter. Hydraulic fluid 440 is induced into upper piston area 520 to expand sealing element 340 around drill pipe 400, when hydraulic fluid 440 is so induced, it acts upon upper piston area 520 to create a downward force on inner housing 300. Force on upper piston area 520 is defined by the equation $F(up)=A(up)\times P(h)$ where P(h)=induced hydraulic pressure. Pressurized hydraulic fluid 440 energizes upper piston area 520 exerting a downward force on inner housing 300. Upper piston area 520 remains constant.

Lower piston area 510 is defined by the equation $A(lp)=(\pi\times(D)(b)^2-D(p)^2)/4$ where D(b)=the outer diameter of lower dynamic rotary seal 326 and where D(p)=the outer diameter of drill pipe 400. Thus, a smaller diameter pipe results in a larger cross sectional area for lower piston area 510. Pressurized wellbore fluid 410 acts upon lower piston area 510 to create an upward force on inner housing 300. Force on lower piston area 510 is defined by the equation $F(lp)=A(lp)\times P(wb)$ where P(wb)=wellbore pressure. Wellbore fluid 410 exerts an upward force on inner housing 300 as it presses upward into lower piston area 510. Lower piston area 510 does not remain constant and varies in size due to drill pipe diameter changes as the drill pipe is lowered, or raised, through RCPH 500.

Vented area 345 is defined as an area between the outer diameter of middle dynamic rotary seal 324 and the outer diameter of lower dynamic rotary seal 326. Vent port 106 allows vented area 345 to remain at atmospheric pressure. By keeping vented area 345 at atmospheric pressure a pressure imbalance is created such that upper piston area 520, when it is energized by pressurized hydraulic fluid 440, creates a force opposite that of lower piston area 510 when it is energized by wellbore fluid 410.

Figure 3:
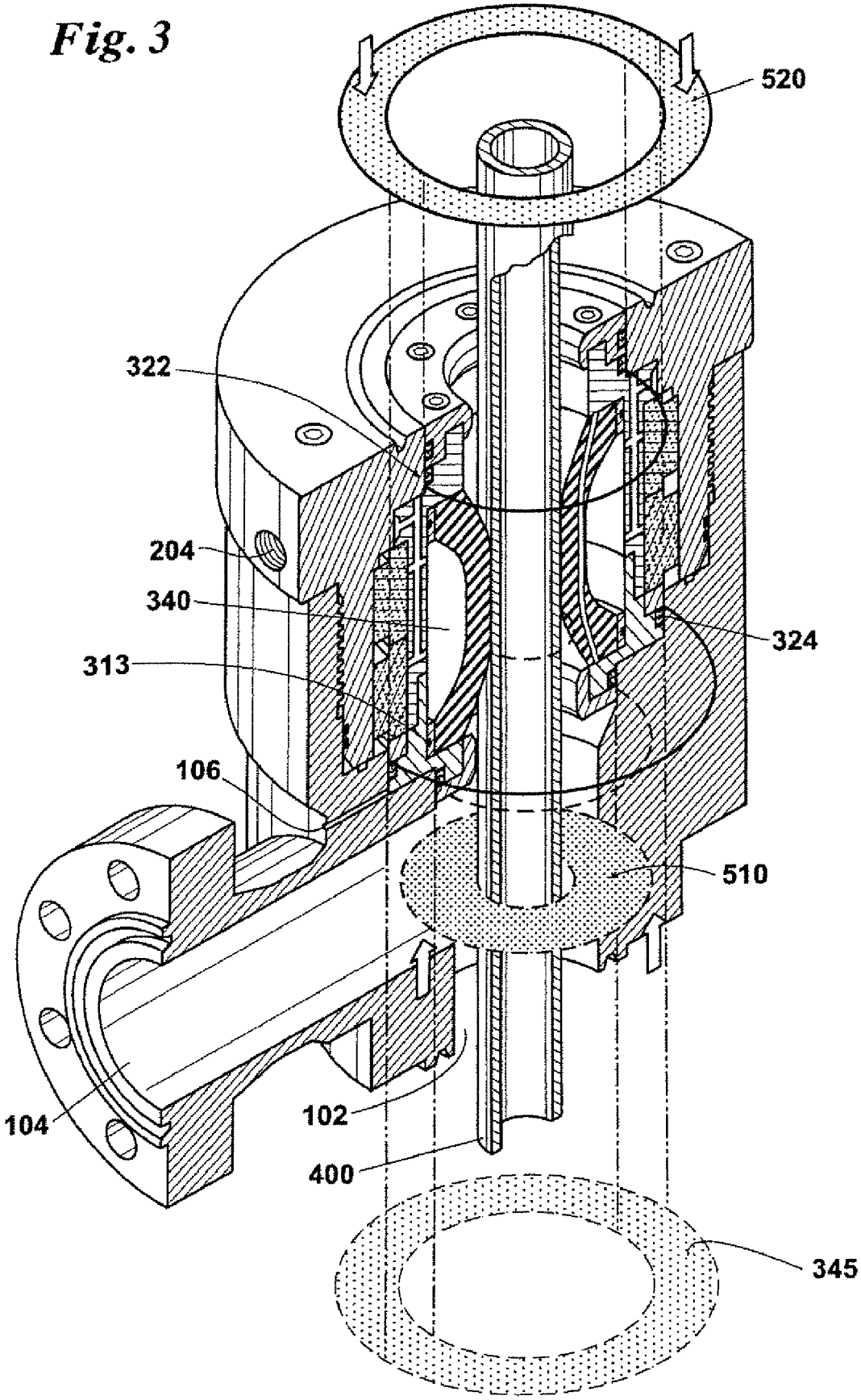
FIG. 3 is a perspective view of the RPCD.

FIG. 3 is a perspective view of RPCH 500 showing upper piston area 520 and lower piston area 510. Upper piston area 520 is an area between the outer diameter of middle dynamic seal ring 324 and the outer diameter of upper dynamic rotary seal 322 defined by the upper piston area formula set forth above. Lower piston area 510 is an the area between the outer diameter of lower dynamic seal element 326 and the outer diameter of drill pipe 400 defined by the lower piston area formula set forth above.

The upward and downward forces on inner housing 300 are also affected by the frictional drag of the pipe moving through the collapsed sealing element 340, as described by the equation: $F(f)=(\pi\times D(p)\times L)\times P(h)\times u$ where L=length of pipe 400 in contact with sealing element 340, and where u=coefficient of drag between pipe 400 and sealing element 340.

The sum of the total forces on inner housing 300 is calculated with the equation $F(sum)=F(lp)-F(up)+/-F(f)$. The sign for the friction force F(f) depends on whether drill pipe 400 is moving upwards or downwards. If drill pipe 400 is moving upwards, F(f) is positive. If drill pipe 400 is moving downward, F(f) is negative. A positive F(sum) indicates a net upward force on inner housing 300, the bearings and seals. A negative F(sum) indicates a net downward force on inner housing 300, the bearings and seals.

Pressure balanced rotating pressure control device 500 allows drillers to use pressurized hydraulic fluid 440 to compensate for upward and downward forces on inner housing 300. By compensating for differences in upward and downward forces on inner housing 300, heat and/or wear on upper bearing 332 and lower bearing 334 will be reduced and the life of upper bearing 332 and lower bearing 334 will be expanded.

Figure 4:
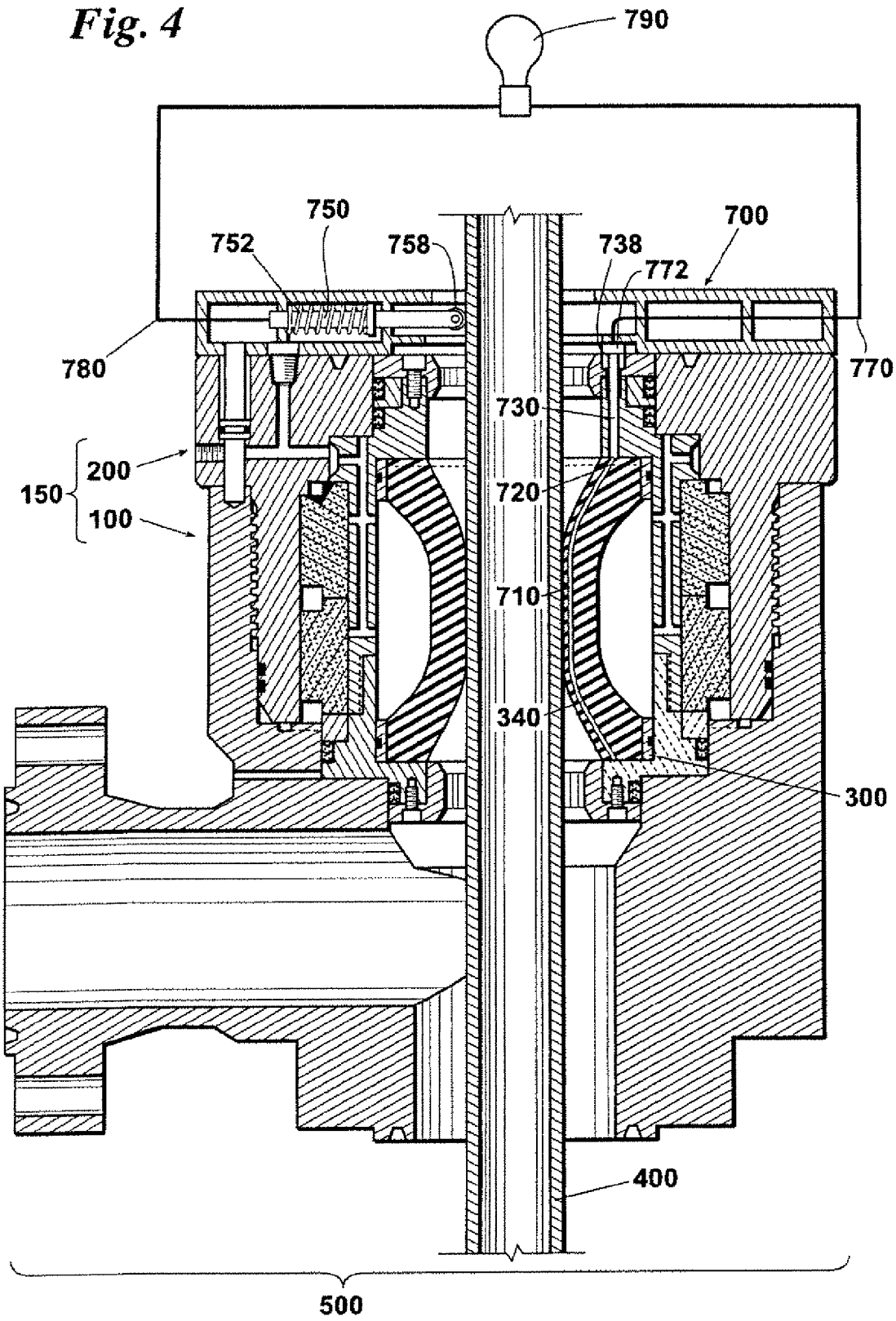
FIG. 4 is a cross sectional view of the RPCD with a wear indicator top plate.

A wear indicator is used to signal when it is time to replace the drill pipe sealing element. FIG. 4 is a cross sectional elevation view of a wear indicator on pressure balanced RPCD 500. Upper body 200 and lower body 100 form outer housing 150. Inner housing 300 rotates inside outer housing 150. Inner housing 300 contains sealing element 340 adapted to constrict around drill pipe 400. Top plate 700 is attached to the top of RPCD 500, which is electrically insulated from the top plate 700.

Conductive strip 710 is embedded axially in sealing element 340 at a depth where, when worn down, sealing element 340 should be replaced. Conductive ring 720 contacts the top end of conductive strip 710. Conductive strip 710 and conductive ring 720 are electrically isolated from inner housing 300 and other conductive surfaces by sealing element 340.

Bolt 730 (described in FIG. 5 below) connects conductive ring 720 to first electrode 770 with brush 738. First electrode 770 passes through top plate 700. First electrode 770 leads to indicator 790.

Second electrode 780 connects indicator 790 to pin 750 (described in FIG. 6 below). Pin 750 is located inside of top plate 700. Spring 752 holds pin 750 against drill pipe 400 creating an electrical contact through conductor 758.

Figure 5:
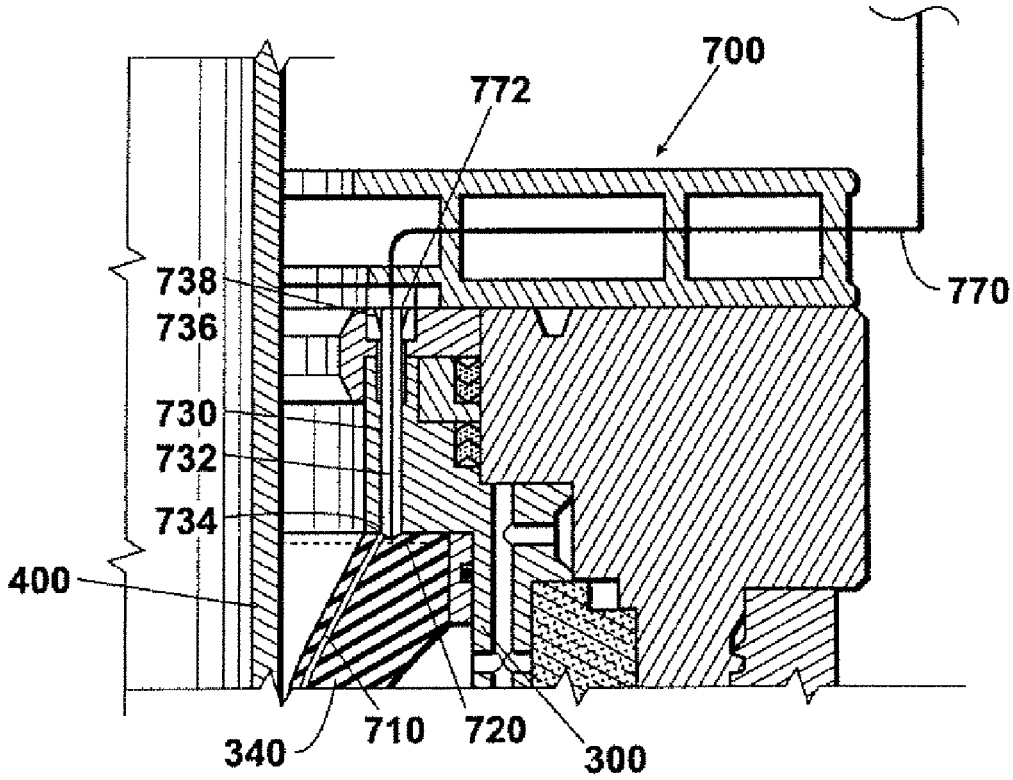
FIG. 5 is a detail view of a conductive bolt.

FIG. 5 shows a cross-sectional detail of bolt 730. Bolt 730 is a special insulated bolt having conductor 732 running axially through the center of bolt 730 which is electrically insulated from the body of the bolt 730. Bolt conductor 732 extends below bolt 730 creating contact point 734. Spring loaded electric brush 738 is located at top end 736 of bolt 730. Spring loaded electric brush 738 is attached to bolt conductor 732 and is electrically isolated from the body of bolt 730.

No alignment is required when installing sealing element 340 in RPCD 500. Once sealing element 340 is installed inside inner housing 300, bolt 370 is threaded through the upper portion of inner housing 300, driving the contact point 734 into sealing element 340. The location of bolt 730 is such that the contact point 734 will pierce conductive ring 720 establishing an electric circuit from conductive strip 710 in sealing element 340, through conductive ring 720 and into bolt 730. Note that bolt 730 rotates with inner housing 300 as drill pipe 400 is turned.

Commutator ring 772 on top plate 700 is aligned such that spring loaded electric brush 738 remains in contact with commutator ring 772 as inner housing 300 rotates with turning drill pipe 400. Thus, an insulated electrical conductor path is established from conductive strip 710 in sealing element 340, through conductive ring 720) through bolt conductor 732 in bolt 730, through spring loaded electric brush 738, through commutator ring 772, and out first electrode 770.

Figure 6:
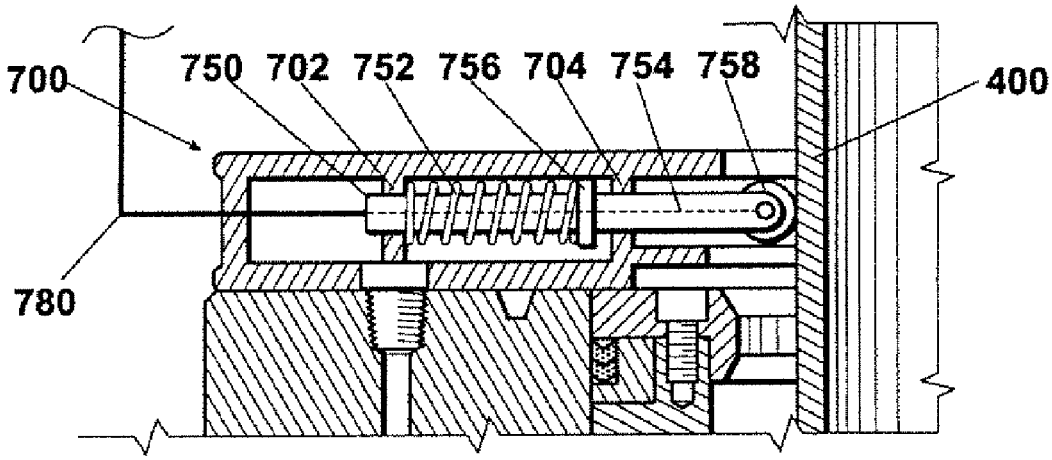
FIG. 6 is detail view of a conductive pin.

FIG. 6 shows a detail of pin 750 mounted inside top plate 700. Pin 750 is spring loaded inside top plate 700, through outer aperture 702 and inner aperture 704. Spring 752 exerts force between top plate 700 and rib 756 on pin 750. Pin conductor 754 passes through pin 750 connecting pipe contactor 758 to second electrode 780. Pin 750 is electrically insulated from top plate 700.

Pin 750 is retracted as drill pipe 400 is lowered through RPCH 500 and is then allowed to spring against drill pipe 400. Spring 752 keeps pipe contactor 758 in contact with drill pipe 400 as tool joints and other such changes in drill pipe 400 outside diameter pass through RPCH 500. Thus, an electrical circuit is established from drill pipe 400, through pipe contactor 758, through pin conductor 754 inside pin 750, and out through second electrode 780.

Figure 7:
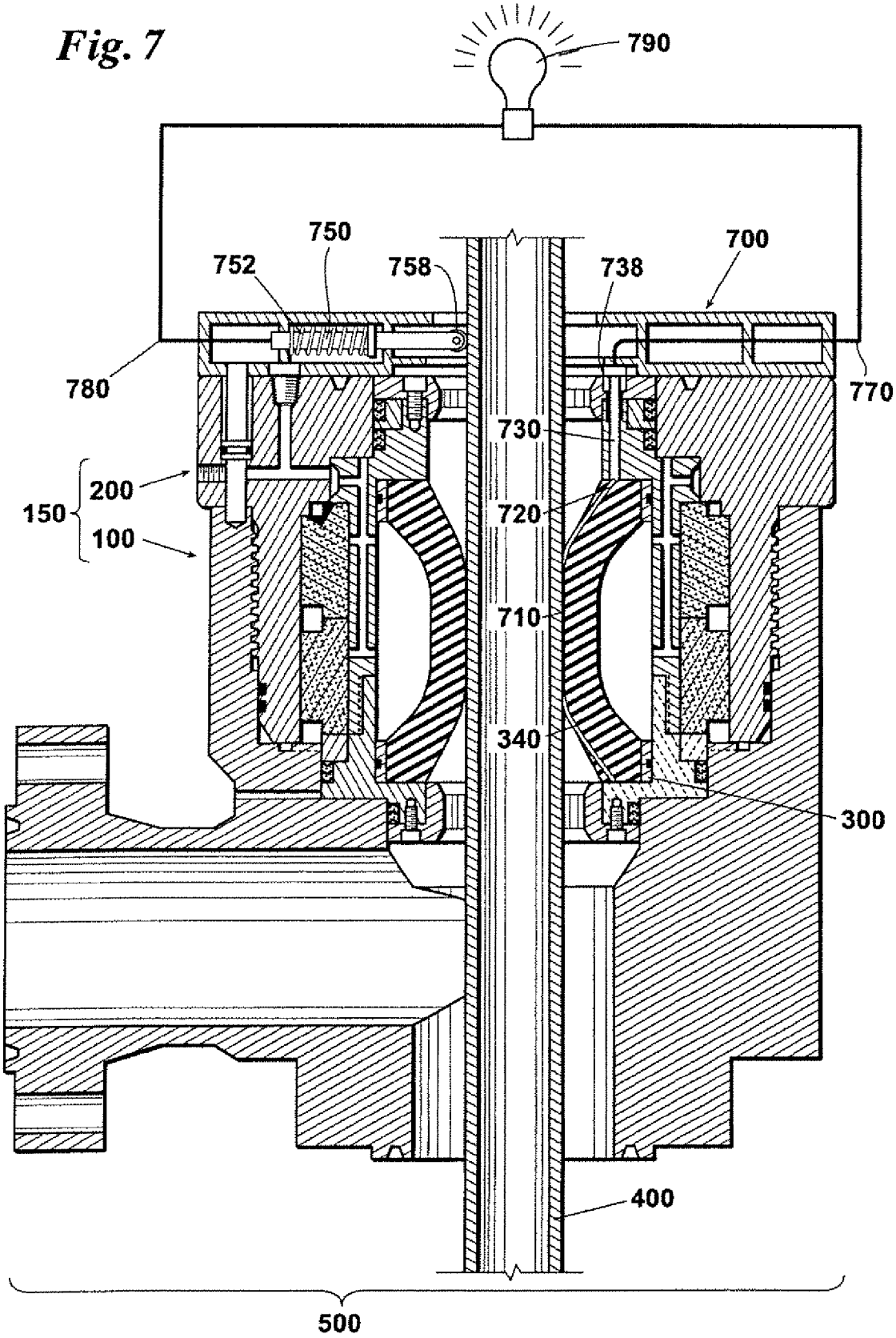
FIG. 7 is a cross sectional view of the RPCD with a closed circuit caused by a worn sealing element.

FIG. 7 is a cross sectional elevation view of pressure balanced rotating pressure control device 500 with a closed circuit caused by worn sealing element 340. Whenever sealing element 340 wears down, exposing conductive strip 710, drill pipe 400 makes physical and electrical contact with conductive strip 710. A closed circuit is formed from indicator 790 through first electrode 770, brush 738, bolt 730, conductive ring 720, conductive strip 710, drill pipe 400, conductor 758, pin 750, and second electrode 780, causing a reading on indicator 790. The reading on indicator 790 after the circuit is closed alerts users of RPCD 500 that it is time to replace sealing element 340.

Persons skilled in the art are aware that a normally closed circuit could also be employed. With a normally closed circuit, the electrically conductive path is in place at all times until wear of the sealing element causes conductive strip 710 to sever, opening the circuit and causing indicator 790 to alert users of RPCD 500 that it is time to replace sealing element 340. In other words, during normal operation, an indicator light would be on, and when the circuit is broken, the indicator light would turn off.

With respect to the above description, it is to be realized that the optimum dimensional relationships for the parts of the invention, to include variations in size, materials, shape, form, function, manner of operation, assembly, and use are deemed readily apparent and obvious to one of ordinary skill in the art. The present invention encompasses all equivalent relationships to those illustrated in the drawings and described in the specification. The novel spirit of the present invention is still embodied by reordering or deleting some of the steps contained in this disclosure. The spirit of the invention is not meant to be limited in any way except by proper construction of the following claims.

What is claimed is:

1. A rotating pressure control device comprising:

an outer housing;

an inner housing with a sealing element, the inner housing adapted for rotation within the outer housing by an upper bearing and a lower bearing;

wherein a constriction of the sealing element to a drill pipe is controlled by a pressure of a hydraulic fluid;

wherein an upper piston area is created between an upper dynamic rotary seal and a middle dynamic rotary seal;

wherein a lower piston area is created between an outside surface of the drill pipe and an outside diameter of a lower dynamic sealing element;

wherein the pressure of the hydraulic fluid is adjusted to create a downward force in the upper piston area so that a total load transmitted from the inner housing through the upper bearing and the lower bearing to the outer housing is balanced; and wherein the middle dynamic rotary seal is located between the inner housing and the outer housing and below the sealing element.

2. The rotating pressure control device of claim 1 wherein the upper dynamic rotary seal is located between the inner housing and the outer housing and above the sealing element.

3. The rotating pressure control device of claim 1 wherein a lower dynamic rotary seal is located between the inner housing and the outer housing and below the middle dynamic rotary seal.

4. The rotating pressure control device of claim 3 further comprising:

a vent port in the outer housing;

wherein the vent port is located between the middle dynamic rotary seal and the lower dynamic rotary seal; and wherein the vent port maintains an atmospheric pressure in a vented area between the middle dynamic rotary seal and the lower dynamic rotary seal.

5. The rotating pressure control device of claim 1 wherein wellbore fluid pressurizes the lower piston to create an upward force on the inner housing.

6. A method of balancing pressure on a rotating pressure control device having an inner housing rotatably engaged with an outer housing by an upper bearing and a lower bearing, and having an upper piston area, comprising the steps of activating a sealing element to constrict a dill pipe outer diameter to form a lower piston area;

locating a middle dynamic rotary seal between the inner housing and the outer housing and below the sealing element; and responsive to a wellbore fluid pressurizing the lower piston area, adjusting a hydraulic pressure in the upper piston area to balance a plurality of net forces on the inner housing so that a total load transmitted through the upper bearing and the lower bearing to the outer housing is balanced.

7. The method of claim 6 further comprising the step of:

using a vent port in the outer housing, located between a middle dynamic rotary seal and a lower dynamic rotary seal to maintain an atmospheric pressure between the middle dynamic rotary seal and the lower dynamic rotary seal.

8. The method of claim 6 further comprising the step of:

locating an upper dynamic rotary sad between the inner housing and the outer housing and above the sealing element.

9. The method of claim 6 further comprising the step of:

locating a lower dynamic rotary seal between the inner housing and the outer housing and below a middle dynamic rotary seal.

* * * * *